US006977614B2

(12) United States Patent
Poe et al.

(10) Patent No.: US 6,977,614 B2
(45) Date of Patent: Dec. 20, 2005

(54) MICROSTRIP TRANSITION AND NETWORK

(75) Inventors: Gregory C. Poe, Chepachet, RI (US); Charles D. McCarrick, Plymouth, MA (US)

(73) Assignee: KVH Industries, Inc., Middletown, RI (US)

( * ) Notice: Subject to any disclaimer, the term of this patent is extended or adjusted under 35 U.S.C. 154(b) by 21 days.

(21) Appl. No.: 10/753,616

(22) Filed: Jan. 8, 2004

(65) Prior Publication Data

US 2005/0151687 A1 Jul. 14, 2005

(51) Int. Cl.[7] ..... H01Q 1/38
(52) U.S. Cl. ..... 343/700 MS; 343/846; 343/853
(58) Field of Search ..... 343/700 MS, 771, 343/846, 848, 829, 833, 834, 853

(56) References Cited

U.S. PATENT DOCUMENTS

| | | | | |
|---|---|---|---|---|
| 2,508,085 A | | 5/1950 | Alford | 250/33 |
| 4,370,657 A | | 1/1983 | Kaloi | 343/700 |
| 4,686,535 A | | 8/1987 | Lalezari | 343/700 |
| 4,853,657 A | | 8/1989 | Cruchon et al. | 333/137 |
| 4,994,820 A | * | 2/1991 | Suzuki et al. | 343/846 |
| 5,008,681 A | | 4/1991 | Cavallaro et al. | 343/700 |
| 5,166,693 A | | 11/1992 | Nishikawa et al. | 342/422 |
| 5,181,042 A | | 1/1993 | Kaise et al. | 343/700 |
| 5,210,542 A | | 5/1993 | Pett et al. | 343/700 |
| 5,220,335 A | | 6/1993 | Huang | 343/700 |
| 5,231,406 A | | 7/1993 | Sreenivas | 343/700 |
| 5,245,349 A | | 9/1993 | Harada | 343/700 |
| 5,382,959 A | | 1/1995 | Pett et al. | 343/700 |
| 5,384,557 A | | 1/1995 | Yoshida et al. | 333/21 A |
| 5,630,226 A | | 5/1997 | Kanda et al. | 455/313 |
| 5,801,599 A | | 9/1998 | Flynn et al. | 333/26 |
| 6,122,482 A | | 9/2000 | Green, Sr. et al. | 455/3.2 |
| 6,188,367 B1 | | 2/2001 | Morrison et al. | 343/765 |
| 6,204,823 B1 | | 3/2001 | Spano et al. | 343/766 |
| 6,297,774 B1 | | 10/2001 | Chung | 343/700 |
| 6,334,045 B1 | | 12/2001 | Green, Sr. et al. | 455/3.02 |
| 6,396,440 B1 | | 5/2002 | Chen | 343/700 |
| 6,397,038 B1 | | 5/2002 | Green, Sr. et al. | 455/3.02 |
| 6,407,717 B2 | | 6/2002 | Killen et al. | 343/815 |
| 6,421,012 B1 | | 7/2002 | Heckaman | 343/700 |
| 6,424,817 B1 | | 7/2002 | Hadden et al. | 455/3.02 |
| 6,452,550 B1 | | 9/2002 | Channabasappa et al. | 343/700 |
| 6,469,673 B2 | * | 10/2002 | Kaiponen | 343/703 |
| 6,473,057 B2 | | 10/2002 | Monzon | 343/909 |
| 6,496,146 B1 | | 12/2002 | Chang et al. | 343/700 |
| 6,512,431 B2 | | 1/2003 | Pergande | 333/246 |
| 6,538,612 B1 | | 3/2003 | King | 343/757 |
| 6,710,749 B2 | | 3/2004 | King | 343/757 |
| 6,825,809 B2 | * | 11/2004 | Aoki et al. | 343/700 MS |

(Continued)

OTHER PUBLICATIONS

KVH Makes Satellite TV a Reality in Autos with Revolutionary Ultra-low Profile Antenna, Press Release, Jan. 9, 2003.

(Continued)

*Primary Examiner*—Tan Ho
(74) *Attorney, Agent, or Firm*—Foley Hoag, LLP

(57) ABSTRACT

Disclosed are systems, methods, and an apparatus that includes a microstrip network disposed on a ground plane and including at least one collection point, where the collection point(s) is in electrical communication with the microstrip network, a probe associated with each collection point, the probe extending through at least one opening in the ground plane and in electrical communication with one or more transmission line(s), and, a physical perturbation associated with each probe, the physical perturbation integrated with the transmission line(s) to create at least a first and a second signal port in the transmission line(s).

39 Claims, 6 Drawing Sheets

U.S. PATENT DOCUMENTS

| | | | | |
|---|---|---|---|---|
| 6,856,300 | B2 * | 2/2005 | McCarrick | 343/853 |
| 6,864,846 | B2 | 3/2005 | King | 343/757 |
| 2001/0050654 | A1 | 12/2001 | Killen et al. | 343/817 |
| 2001/0055948 | A1 | 12/2001 | Ikeda et al. | 455/13.3 |
| 2002/0067311 | A1 | 6/2002 | Wildey et al. | 342/372 |
| 2002/0167449 | A1 | 11/2002 | Frazita et al. | 343/756 |
| 2003/0011514 | A1 | 1/2003 | Kirchofer et al. | 342/372 |
| 2003/0020663 | A1 | 1/2003 | Bolzer et al. | 343/770 |
| 2003/0142028 | A1 | 7/2003 | Mahon | 343/772 |
| 2003/0194985 | A1 | 10/2003 | Nakamura | 455/323 |
| 2005/0151688 | A1 * | 7/2005 | Khoo et al. | 343/700 |

OTHER PUBLICATIONS

Patricia A. Loth; "Recent Advances in Waveguide Hybrid Junctions*" IRE Transactions on Microwave Theory and Techniques, Oct. 1956, p268-271.

International Search Report of PCT/US04/00398 mailed May 16, 2005.

* cited by examiner

MICROSTRIP TRANSITION AND NETWORK

CROSS-REFERENCE TO RELATED APPLICATIONS

This patent application is co-pending with a related patent application Ser. No. 10/753,111 entitled "Low Noise Block", filed this same day on Jan. 8, 2004, the contents of which are incorporated herein by reference in their entirety.

BACKGROUND

Antennas may stand alone, or may be mounted on, for example, moving vehicles and stationary objects including buildings. The height or the size of such antennas may be restricted based on legal, aesthetic, fuel efficiency, and/or other considerations. In some applications, a small footprint of an antenna may also be desirable. Antennas for mobile communications that rely on satellite broadcasted signals may include slotted antenna arrays and phased array antennas, and may be capable of elevation tracking, for example, to account for differences in arrival time of a signal, so that rotation and/or tilting of the antenna may not, at least in part, be necessary. In certain applications, phased array antennas may include both microstrip antenna elements and waveguides. In a standard waveguide, the height of the waveguide can be one-half the width of the waveguide. A reduced height waveguide may have a height less than one-half the width.

Communications received and/or transmitted from antennas include circularly polarized signals. Television signals may be broadcast from multiple satellites co-located in geosynchronous orbit. These signals may accordingly be circularly polarized, with one set of signals being, for example, right-hand circularly polarized and the other left-hand circularly polarized, dual-elliptical polarizations, or linearly polarized.

SUMMARY

Disclosed is a device that can include, for example, an antenna, where the device includes a microstrip network disposed on a ground plane. The device also includes one or more collection points, where the collection point(s) are in electrical communication with the microstrip network. The device also includes a probe associated with each of the collection points, where the probe extends through at least one opening in the ground plane and is in electrical communication with one or more first transmission lines. The device includes a first physical perturbation associated with the probe, where the first physical perturbation is integrated with the first transmission line(s) to create first and second signal ports in the first transmission line(s). As provided herein, integrated can be understood to include "part of," "attached to," "incorporated into," "incorporated with," "joined," "united," and/or "unified."

The first physical perturbation can thus include one or more of a post, a cylinder, a ridge, a cleft, an iris, and a transmission line width. The first physical perturbation can be based on one or more of a characteristic impedance of the first transmission line(s), and a desired directivity of signals propagating along the first transmission line(s). Accordingly, the first physical perturbation can be responsible for a conjugate match that can provide directivity to signals propagating along the first transmission line(s). The physical characteristic(s) of the first physical perturbation can be selected based on one or more of a characteristic impedance of the first transmission line(s), and a desired directivity of signals propagating along the first transmission line(s). The physical characteristic(s) can include one or more of a shape, a size, a width, a physical dimension, a position, a distance from the associated probe, a physical association with the first transmission line(s), and a physical association to the first transmission line(s).

For the disclosed device, the device collection point(s) can be capable of receiving energy from the microstrip network, and/or delivering energy to the microstrip network. Further, the probe(s) can be capable of delivering energy to the first transmission line(s), and/or receiving energy from the first transmission line(s). Accordingly, the probe, the first port, and the second port can be associated with a three port signal coupler, where the coupler can be provided and/or facilitated by the first physical perturbation.

The collection point(s) can communicate one of right-hand circularly polarized energy or left-hand circularly polarized energy. Further, the first transmission line(s) can include at least one transmission line for right-hand circularly polarized energy and/or at least one transmission line for left-hand circularly polarized energy.

In one embodiment, the first transmission line(s) includes a rectangular waveguide channel, and/or the microstrip network includes microstrip patch elements. In some embodiments, the microstrip patch elements can include driven patch elements. The microstrip patch elements can be coupled and/or connected with at least one second transmission line.

In an embodiment, the microstrip network includes multiple driven patch elements associated with a common collection point. In some embodiments, six or eight driven patch elements can be associated with a common collection point. The driven patch elements can be connected with the common collection point by the second transmission line(s), where the second transmission line(s) can also be integrated with a second physical perturbation. The second physical perturbation can have the same characteristics and/or features and/or considerations as the first physical perturbation. In one embodiment, for example, the second physical perturbation can be a linewidth change in the second transmission line(s).

In an embodiment, the microstrip network can include an array of the driven patch elements. Further, the probe can include a spacer and/or insulating element, and the spacer element can be, for example, a material such as Teflon® and/or a fluoropolymer.

Also disclosed is an antenna, where the antenna includes, among other things, a microstrip network disposed on a ground plane and with one or more collection point(s), where the collection point(s) is in electrical communication with the microstrip network, a first waveguide assembly, and a probe associated with each of the collection points, where the probe extends through one or more openings in the ground plane and to the first waveguide assembly, where the first waveguide assembly is integrated with at least one physical perturbation, the physical perturbation(s) associated with the probe and integrated with said first waveguide assembly to create a first and a second signal port in the first waveguide assembly. The first waveguide assembly includes a first waveguide channel for communicating substantially left hand circularly polarized signals, and/or a second waveguide channel for communicating substantially right hand circularly polarized signals. The first and second waveguide channels can be independently electrically isolated, and can, for example, be separated by a waveguide wall that includes a recess along the top of the wall. The wall ridges and/or recess can be substantially filled with a composition comprising a conductive epoxy resin.

The microstrip network of the disclosed antenna can include a two dimensional array of microstrip patch elements and collection points, where at least one of a row and/or a column of the collection points is physically aligned with the first waveguide channel.

In one embodiment of the disclosed antenna, the physical perturbation can include a post, a cylinder, a ridge, a cleft, an iris, and/or a waveguide width. The location of the physical perturbation can be based on a width of the first waveguide channel.

The disclosed antenna can also include a second waveguide assembly in electrical communication with the first waveguide assembly. Accordingly, in one embodiment, a first signal junction can communicate signals between (e.g., to and/or from) the second waveguide assembly. In one embodiment, the second waveguide assembly can be substantially fan-shaped, and/or can include varying length waveguide channels. For such embodiments, the varying length waveguide channels can introduce one or more time delays to compensate for the tilt of the antenna.

The second waveguide assembly can include a second signal junction that can communicate signals between the second waveguide assembly, and another device such as a transmission line, coaxial cable, etc. The second waveguide assembly can also include one or more physical perturbations as provided herein.

BRIEF DESCRIPTION OF THE DRAWINGS

These and other features and advantages of the antennas, systems and processes disclosed herein will be more fully understood by reference to the following illustrative, non-limiting detailed description in conjunction with the attached drawings in which like reference numerals refer to like elements throughout the different views. The drawings illustrate principals of antennas, systems and processes disclosed herein and, although not to scale, may show relative dimensions.

DETAILED DESCRIPTION

Figure 1:
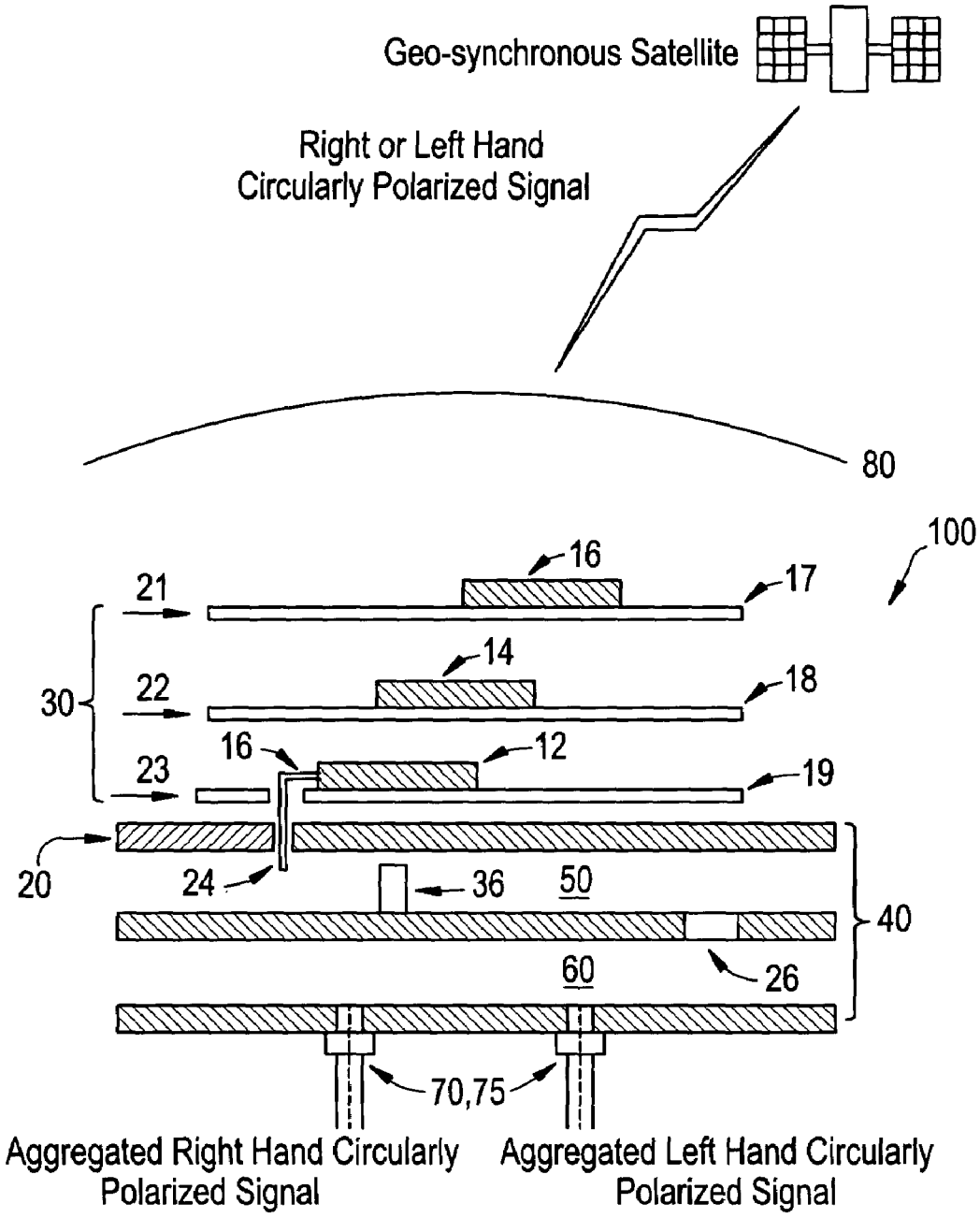
FIG. 1 is a schematic representation of a microstrip waveguide combiner antenna.

To provide an overall understanding, certain illustrative embodiments will now be described; however, it will be understood by one of ordinary skill in the art that the systems and methods described herein can be adapted and modified to provide systems and methods for other suitable applications and that other additions and modifications can be made without departing from the scope of the systems and methods described herein.

Unless otherwise specified, the illustrated embodiments can be understood as providing exemplary features of varying detail of certain embodiments, and therefore, unless otherwise specified, features, components, modules, and/or aspects of the illustrations can be otherwise combined, separated, interchanged, and/or rearranged without departing from the disclosed systems or methods. Additionally, the shapes and sizes of components are also exemplary and unless otherwise specified, can be altered without affecting the scope of the disclosed and exemplary systems or methods of the present disclosure.

For convenience, before further description of the present disclosure, certain terms employed in the specification, examples and appended claims are collected here. These definitions should be read in light of the remainder of the disclosure and understood as by a person of skill in the art. Unless defined otherwise, technical and scientific terms used herein have the same meaning as commonly understood by a person of ordinary skill in the art.

The articles "a" and "an" are used herein to refer to one or to more than one (i.e., to at least one) of the grammatical object of the article. By way of example, "an element" means one element or more than one element.

The terms "comprise" and "comprising" are used in the inclusive, open sense, meaning that additional elements may be included.

The term "including" is used to mean "including but not limited to". "Including" and "including but not limited to" are used interchangeably.

Unless otherwise stated, use of the word "substantially" can be construed to include a precise relationship, condition, arrangement, orientation, and/or other characteristic, and deviations thereof as understood by one of ordinary skill in the art, to the extent that such deviations do not materially affect the disclosed methods and systems.

An "antenna" includes a structure or device that may be used, at least in part, to collect, radiate, and/or transmit, electromagnetic waves.

An "antenna array" includes an assembly of antenna elements with dimensions, spacing, and/or illumination sequence.

A "channel" includes a path provided by a transmission medium via either a physical separation and/or an electrical separation, such as for example, by frequency or time-division multiplexing.

A "port" refers to a point at which signals can enter or leave a device.

A "transmission medium" includes a material substance, such as a waveguide, for example a dielectric-slab waveguide, fiber-optic cable, twisted-wire pair, coaxial cable, water, and air, that can be used for the propagation of signals, for example, in the form of modulated radio, light, or acoustic signals and/or waves, from one point to another. Free space can also be considered a transmission medium. Such examples are provided for illustration and not limitation.

A "transmission line" refers to a medium or structure that forms all or part of a path from one place to another for directing the transmission of energy, for example, electric currents, magnetic fields, acoustic waves, or electromagnetic waves. Examples of transmission lines include wires, optical fibers, coaxial cables, closed waveguides and dielectric slabs.

A "waveguide" includes a material, device, or transmission path along which a signal propagates, that confines and guides a propagating electromagnetic wave or signal.

In some embodiments, the antenna disclosed herein is a low profile phased array antenna system that, at least in part, may be pivotable in azimuth and elevation to receive satellite signals. These satellite signals may correspond to, for example, television, music, and/or Internet related data. The antenna may be mounted on a vehicle, house or other stationary or moving object. The antenna may receive geo-stationary satellite signals regardless of whether the object or vehicle on which the antenna is mounted is in motion or stationary. In some embodiments, the antenna of the present disclosure is mounted on a moving vehicle, for example, an automobile.

This disclosure is directed, at least in part, to antennas, waveguides, and methods and devices for receiving and/or transmitting signals and combining received or transmitted signals. The antennas of this disclosure may include, in some embodiments, a phased array, or microstrip network, that includes a plurality of microstrip patch elements that can include several hundred microstrip patch elements. In some embodiments, the antenna may include a three-dimensional array of microstrip patch elements. In one embodiment, microstrip patch elements may be positioned on one or more substantially parallel dielectric substrates above a ground plane, to receive circularly polarized electromagnetic energy transmitted by a geo-stationary satellite. A ground plane can include a substantially conductive material that can include metal.

The electromagnetic signals received by a plurality of individual microstrip patch elements may be combined by microstrip transmission lines between two or more microstrip patch elements. Microstrip patch elements may include metallic elements that may be formed, at least in part, on a dielectric substrate.

In one example embodiment, a geo-stationary satellite may transmit right and/or left-hand circularly polarized signals (referred to herein as RHC signals and LHC signals, respectively) that penetrate a radome of an antenna according to the disclosed methods and systems. In some embodiments, the radome exhibits a thickness equal to about one-half wavelength of a transmitted signal. In other embodiments, the radome thickness is selected as a multiple of the wavelength of the transmitted signal. The antenna may have a thickness of about 4.5 inches.

Accordingly, an antenna of the present disclosure may include a microstrip network and a waveguide combiner and/or transmission line, with one or more three port junctions, or a plurality of three port junctions, extending from the microstrip network into the waveguide combiner or transmission line. For example, electromagnetic signals may be additionally, or separately, combined by a waveguide combiner. Combined signals may form one or more right-hand and/or left-hand circularly polarized signals. The waveguide combiner may include at least one or more independent waveguide assemblies. The combined signal provided by the antenna system disclosed herein may be transmitted to one or more receivers that may extract data (e.g. television, music, and/or Internet related data) for subsequent communication to a user via an interface device, for example, a video screen, computer screen, or speaker. Accordingly, the methods and systems are not limited by a data format, modulation scheme, protocol, encoding scheme, or other act of data manipulation.

FIG. 1 shows a cross-sectional view of an exemplary antenna 100, with a sample radome 80. It can be understood that the disclosed antennas and devices may operate in a transmitting and/or a receiving mode. As the FIG. 1 embodiment indicates, the antenna 100 may be formed by a microstrip network 30 that includes at least one array, and in the FIG. 1 embodiment, includes three arrays 21, 22, 23. For the FIG. 1 embodiment, the arrays 21, 22, 23 can be understood to be arranged on substantially parallel support sheets and/or dielectric substrates 17, 18, 19, where the substantially parallel substrates 17,18, 19 are positioned between a ground plane 20 and the radome 80 and/or transmission medium. The arrays can be arranged on each of the substrates 17, 18, 19 to provide columns and rows of microstrip antenna elements 12, 14, 16, although such arrangement is for convenience, and other arrangements are contemplated. Additionally and/or optionally, microstrip antenna network or array 30 or array 23 may include arrays disclosed in commonly owned pending patent applications U.S. Ser. No. 10/290,667 and U.S. Ser. No. 10/290,666, both with a filing date of Nov. 8, 2002 and both hereby incorporated by reference in their entirety.

For the illustrative FIG. 1 embodiment that includes three layers 21, 22, 23 of microstrip elements 16, 14, 12, microstrip elements 14, 16 on the second and third layers 22, 21 (e.g., two layers closest to the radome) can be understood to be parasitic antenna elements, or elements without a feed, while microstrip antenna elements 12 on the first microstrip layer 23 can be understood to be driven elements. As shown in the example FIG. 1 embodiment, a driven patch element 12 can be understood to be associated with and/or correspond to two parasitic patch elements 14, 16 that are located on the aforementioned second and third substrate layers 22, 21, where such corresponding patch elements 14, 16 can be arranged substantially parallel and above, but offset from, the corresponding driven patch element 12. The various microstrip elements 12, 14, 16 can include and/or otherwise be comprised of a conducting material such as a metal or metal alloy, or another material as known in the art.

Accordingly, an antenna according to the disclosed embodiment may tilt and/or rotate to acquire/receive a signal from a signal source, and/or to transmit a signal to a signal receiver. In one example receiving embodiment, in response to received electromagnetic energy received, electromagnetic energy received on the microstrip patch elements 12, 14, 16 can be electromagnetically coupled to corresponding microstrip patch elements 12 (referred to herein as "driven patch elements") on the dielectric substrate 23 closest to the ground plane 20 such that an electric current can flow on, from, and/or through the driven patch element 12. Accordingly, the electric current associated with the driven patch element 12 can be based on electromagnetically coupled energy received from corresponding parasitic patch elements 14, 16. Such electric current can then be combined with other current received and/or generated by another number, e.g., five or seven, of other driven patch elements (and corresponding parasitic patch elements), where such combination can be performed at a common collection point.

To ensure that the various signals substantially constructively combine at the common collection point, the associated driven patch elements 12 can be rotated relative to each other and can be interconnected by predetermined lengths of microstrip transmission lines such that the phase signals from driven patch elements 12 associated with a common collection point are substantially in-phase when they arrive at the common collection point such as to provide a substantially constructive combination. It may be noted that because of the aforementioned optional row and column arrangement of microstrip elements 12, 14, 16 on a given dielectric substrate 17, 18, 19, when considering the driven elements 12 and the associated collection points, the microstrip network can be understood to further include a plurality of collection points that can be arranged in a similar two dimensional, or column/row configuration.

Referring to FIG. 1, at least one probe 24 can extend from the microstrip network, at a common collection point, or feedpoint, into a transmission line 50 through one or more openings in a ground plane 20. Transmission line 50 may be a waveguide, or part of a waveguide combiner assembly 40. The width of the transmission line may be about one-half the wavelength of the transmitted or received signal.

In some embodiments, there may be a plurality of probes, corresponding to a plurality of collection points, that extend from the microstrip network 30 through an opening or openings in the ground plane 20 into transmission lines 50. For example, a column or row of probes can extend from a column or row of collection or feed points on a microstrip array. Probe 24 may couple and/or connect the microstrip network to a transmission line or waveguide assembly such that probe 24 may provide a physical and/or an electrical connection between the network and assembly, such that the transmission line and/or waveguide assembly may receive or transmit signals to or from the microstrip network.

A first level of combiner assembly 40 may be a transmission line 50, such as a rectangular waveguide assembly. In one embodiment, a transmission line and/or waveguide assembly 50 can be an azimuthal combiner. A waveguide assembly 50, for example, may include one or more channels, and may comprise one or more perturbations, for example, physical perturbations 36 that can contribute to the directivity of the signal in the waveguide, and impedance matching, where the shape and/or position can be selected based on a waveguide width ratio, a receiving frequency (range) of interest, and/or characteristic impedance. Accordingly, the physical perturbation shape and spacing from a probe 24 can be selected to provide a desired and/or selected directivity and/or impedance. For example, in some embodiments, the physical perturbations can includes shapes and/structures that can include a post, a ridge, a cylinder, a cleft, a cube, an iris, a change in width of a transmission line, a change in transmission line dimension (e.g., waveguide width/height) or another shape or other alternation of physical dimension, with such examples provided for illustration and not limitation.

Accordingly, based on the embodiment and the number of probe 24, a waveguide combiner assembly can include multiple physical perturbations 36 that can be in a one-to-one relationship with respect to probe 24, or another ratio, depending upon the embodiment and selected waveguide and/or signal propagation characteristics. Referring again to FIG. 1, the waveguide assembly 40 includes at least one perturbation 36 that is physically offset from a probe 24. A perturbation 36 may be positioned at a distance from a vertical wall of a waveguide assembly, and in one embodiment, a perturbation 36 may optionally be positioned at least about one-quarter signal wavelength from a vertical wall of a waveguide assembly. As provided herein, other perturbations can be used in other embodiments. Further, the height of the perturbation may be selected based on the height of the waveguide.

Accordingly, it can be understood that the combination of probe 24 and physical perturbation 36 can define a coupler for coupling a signal amongst, for example, a microstrip antenna array 30 and a transmission line or waveguide combiner assembly 40. The coupler can be understood to include three ports, where in a receiving mode, a coupler can include two input ports and one output port, while in a transmission mode, a coupler can be understood to include one input port and two output ports. Based on the illustrated assembly of FIG. 1, for example, in a receiving configuration with the probe 24 and perturbation 36 defining a coupler, a received signal from the post can be coupled to the waveguide and provided directivity to travel along the waveguide in a first direction, while also being substantially constructively combined with other signals already in the waveguide/transmission line and also propagating in the first direction. The combined "output" signal thus provides the output "port" of the coupler, with the input "ports" being the probe signal and the existing waveguide signal propagating in the first direction.

With regard to a transmitting mode, for example, a signal propagating in a second direction along the waveguide (e.g., the second direction being opposite to the first, receive direction) may encounter the aforementioned coupler defined by a probe 24 and physical perturbation 36, thus providing an input to the coupler. As provided previously herein, the physical characteristics of the physical perturbation 36 can be selected for directivity and/or impedance matching/mismatching to allow, for example, the input signal to be propagated in the second direction and/or to the probe 24. The ratio of signal directed to the probe 24 and in the second direction (e.g., further propagating in the second direction in the waveguide) can be determined by the embodiment and the selection of the physical perturbation 36 characteristics. Accordingly, it can be understood that in this aforementioned transmission example, the "coupler" defined by the probe 24 and physical perturbation 36 includes one input port and two output ports.

In one embodiment such as the embodiment shown in FIG. 1, the combiner assembly 40 can include successive layered waveguide sections. The second level waveguide assembly 60 may be separated from the first level waveguide assembly or transmission line by a support sheet 41. In an embodiment, a second waveguide assembly 60 may include a shape that may, at least in part, compensate a signal for elevation time delays that may be due, at least in part, to a tilt of the antenna that may cause one part of the antenna to receive a signal "earlier" in time relative to other parts of the antenna. For example, the second level waveguide assembly 60 can include an arced wall, where the arcs can have increased lengths to provide delays for signals that are received earlier than other signals, based on and/or to compensate for the tilt of the antenna. Accordingly, the second waveguide assembly 60 shape can include progressive lengths of waveguides to produce a specific time delay and/or time delay profile across the antenna.

The second waveguide level of a waveguide combiner 40 may further combine individual RHC/LHC row signals into a single RHC/LHC aggregate signal. The aggregate RHC/LHC signal can be subsequently transmitted from the antenna system 100 via at least one separate coaxial cables, 70, 75, or via waveguide ports. In illustrative FIG. 1, one coaxial cable 70 for aggregate RHC signal may be used and another coaxial cable 75 may be used for aggregate LHC signals.

Figure 2:
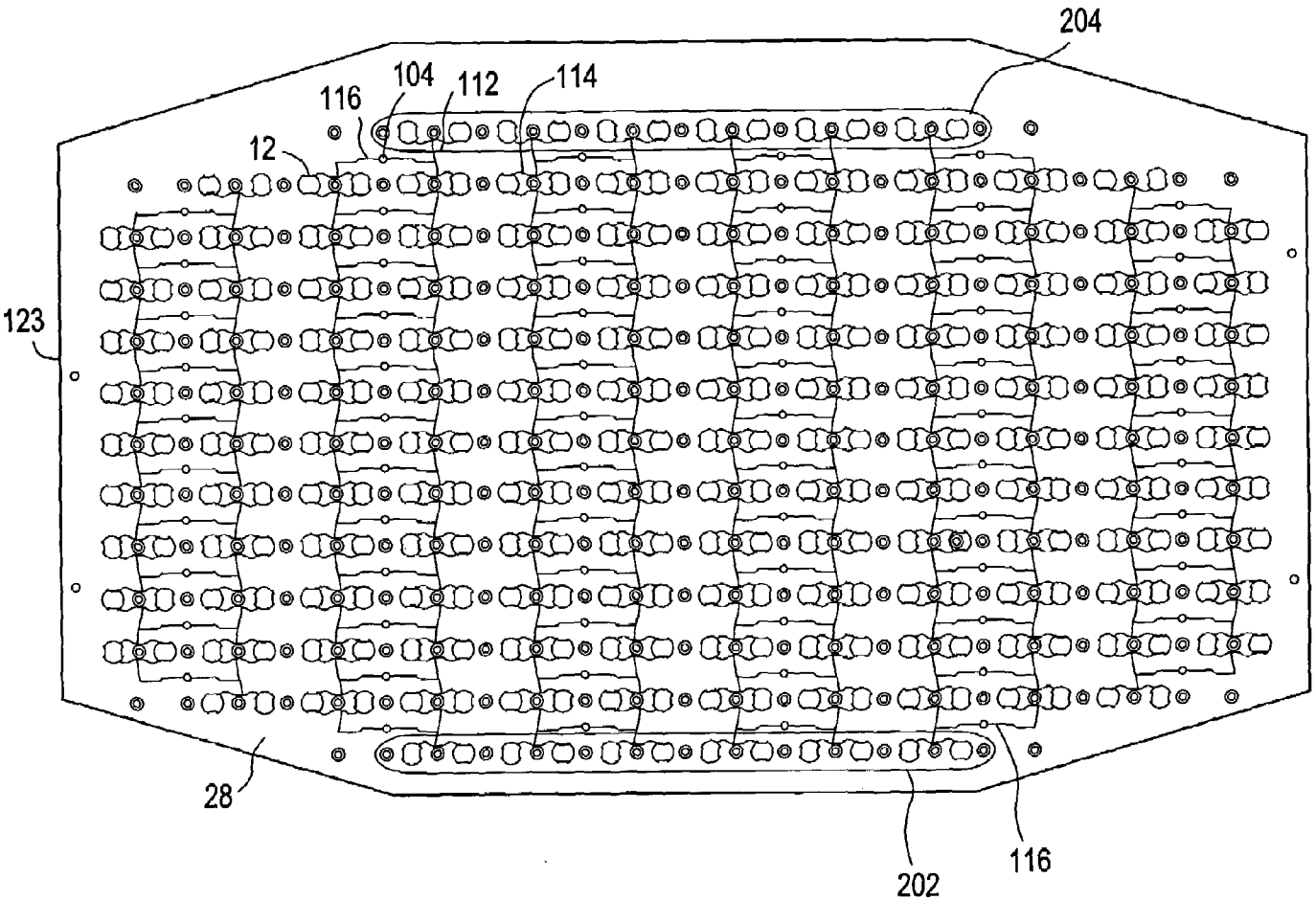
FIG. 2 is a representation of a microstrip antenna array.

FIG. 2 illustrates one arrangement 123 of the driven elements, feed points, microstrip transmission lines and collection points on the lowest substrate 19. Elements 12 can be connected by feed lines 114 to feed points 112, with one feed point 112 connected to a number of elements 12. Elements 12 may be connected by two feed lines 114 that can be connected to two feed points 112. For example, the feed points 112 may be arranged in rows adjacent to the rows of elements 12.

In the exemplary embodiment of FIG. 2, the antenna system includes sixty-eight groupings of patch elements with sixty-eight corresponding common collection points. In the FIG. 2 embodiment, there are two hundred and eighty driven patch elements that form these groupings. The interconnecting microstrip transmission lines and collection points may be located in substantially the same plane as that of the dielectric substrate that may support the array 123.

Referring to FIG. 2, two rows 202, 204 of the driven patch element array have a single feed point to which a microstrip transmission line 116 connects, while driven patch elements in other rows of the FIG. 2 array have two feed points to which microstrip transmission lines connect. For the two-feed-point patch elements, a first feed point is disposed to collect current induced by a RHC polarized signal that is incident on the element, while a second feed point is disposed to collect current induced by a LHC polarized incident signal. On the aforementioned patch elements that have a single feed point, the point is located to collect the current induced by either a RHC or a LHC polarized incident signal, but not both. Accordingly, signals collected by the microstrip transmission lines at the patch element feed points are substantially constructively combined such that signals from six or eight driven patch elements can be combined at a common collection point 104. Those of ordinary skill will understand that other numbers of combined signals can be provided. Accordingly, the FIG. 2 transmission lines are configured such that signals from feed points where LHC polarized signals are to be collected are combined only with LHC signals from other such feed points, while signals from feed points intended to collect RHC polarized signals are combined only with RHC signals from other such feed points. With reference to FIG. 1, FIG. 2 illustrates the overall arrangement of the driven elements, feed points, microstrip transmission lines and collection points on the substrate 23 of the microstrip network 30 that is furthest from the radome (e.g., closest to the waveguide assembly 40).

Figure 3:
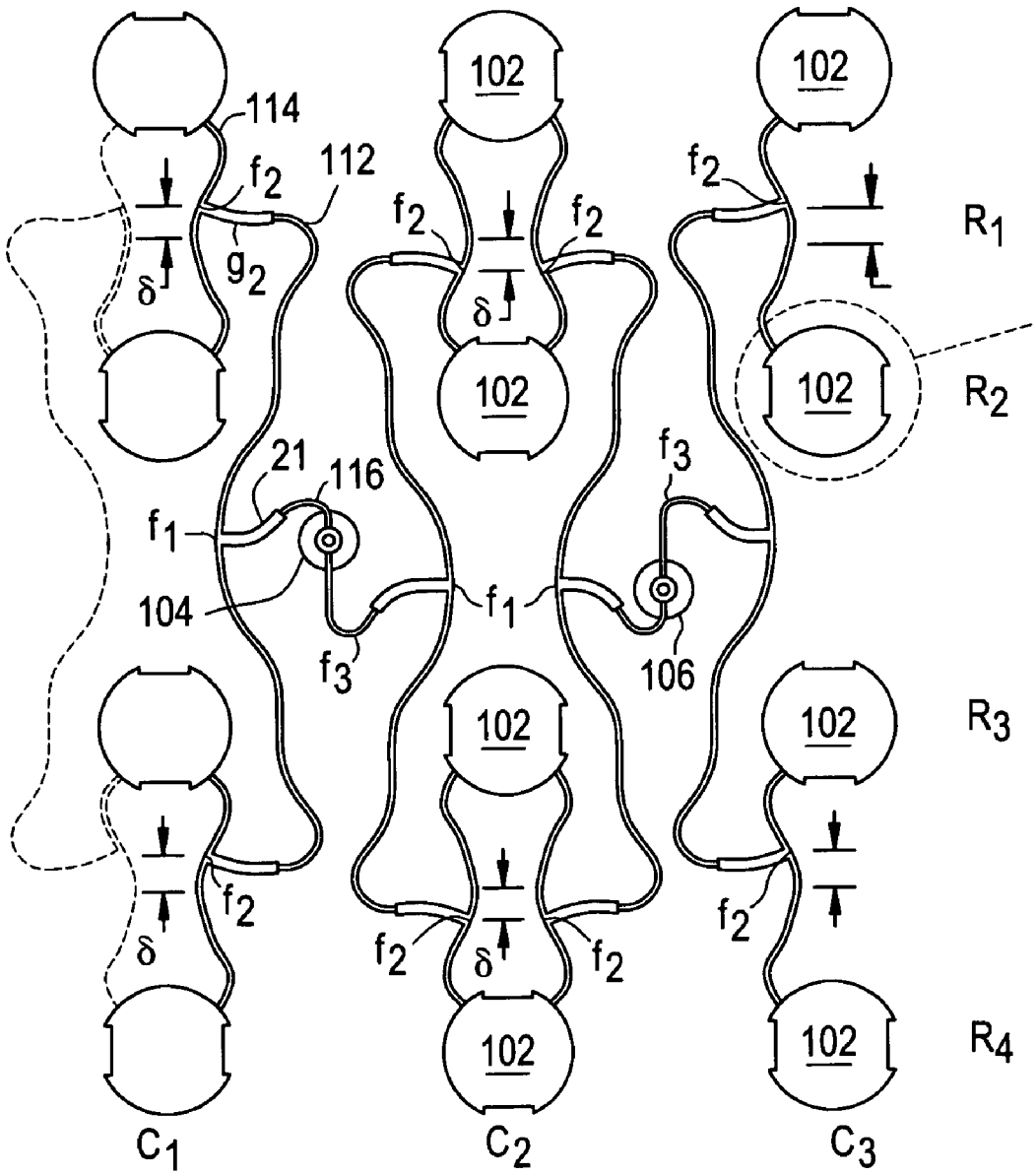
FIG. 3 is a top view of a subset of patch antenna elements illustrating a portion of the network.

FIG. 3 shows a representative subset of microstrip array 23. Elements 102 having feed point or collection point 104 may receive RHC polarized signals and elements 102 having feed point or collection point 106 may receive LHC polarized signals. It is noted that in a transmission mode, elements 102 between common feeds or collection points 104 and 106, i.e. elements of the column of elements designated $C_2$ in FIG. 3, may receive RHC or LHC polarized signals depending on whether the signal is received through collection point 104 or collection point 106, respectively.

In a receive mode, and with reference to collection point 104, the signals from element 102 at row $R_1$, column $C_1$ (1,1), and from element 102 at row $R_3$, column $C_1$ (3,1) can be in phase as they may have substantially equal feed lengths and orientation, the feed being from element 102 to $f_2$, to $f_1$, and to collection points 104. The longer feed length from elements (2,1) and (4,1), as shown by offsets δ, can result in a 90° phase shift for the signals from elements (2,1) and (4,1) relative to the signals from elements (1,1) and (3,1). However, the 90° rotation of elements (2,1) and (4,1) with respect to elements (1,1) and (3,1) can result in the signals from the elements of column $C_1$, being in phase with one another with respect to collection points 104.

As FIG. 3 also illustrates, the geometry and/or linewidth of transmission line feeds 112, 116 can be varied to provide the aforementioned combination of impedance and directivity described relative to the waveguide/transmission line assembly 40. As shown in FIG. 3, the linewidth at perturbations g2 and g1 can be larger, for example, to match the impedance of, and/or direct the signal from element 102 to f2 and then from f2 to f1 to collection point 104. By way of analogy, the linewidth configuration (e.g., variations in linewidth, size of linewidth, and other physical variations of linewidth) can be understood to be comparable and/or analogous to the physical perturbation 36 of the coupler (e.g., probe 24 and physical perturbation/post 36) described previously herein.

Figure 4:
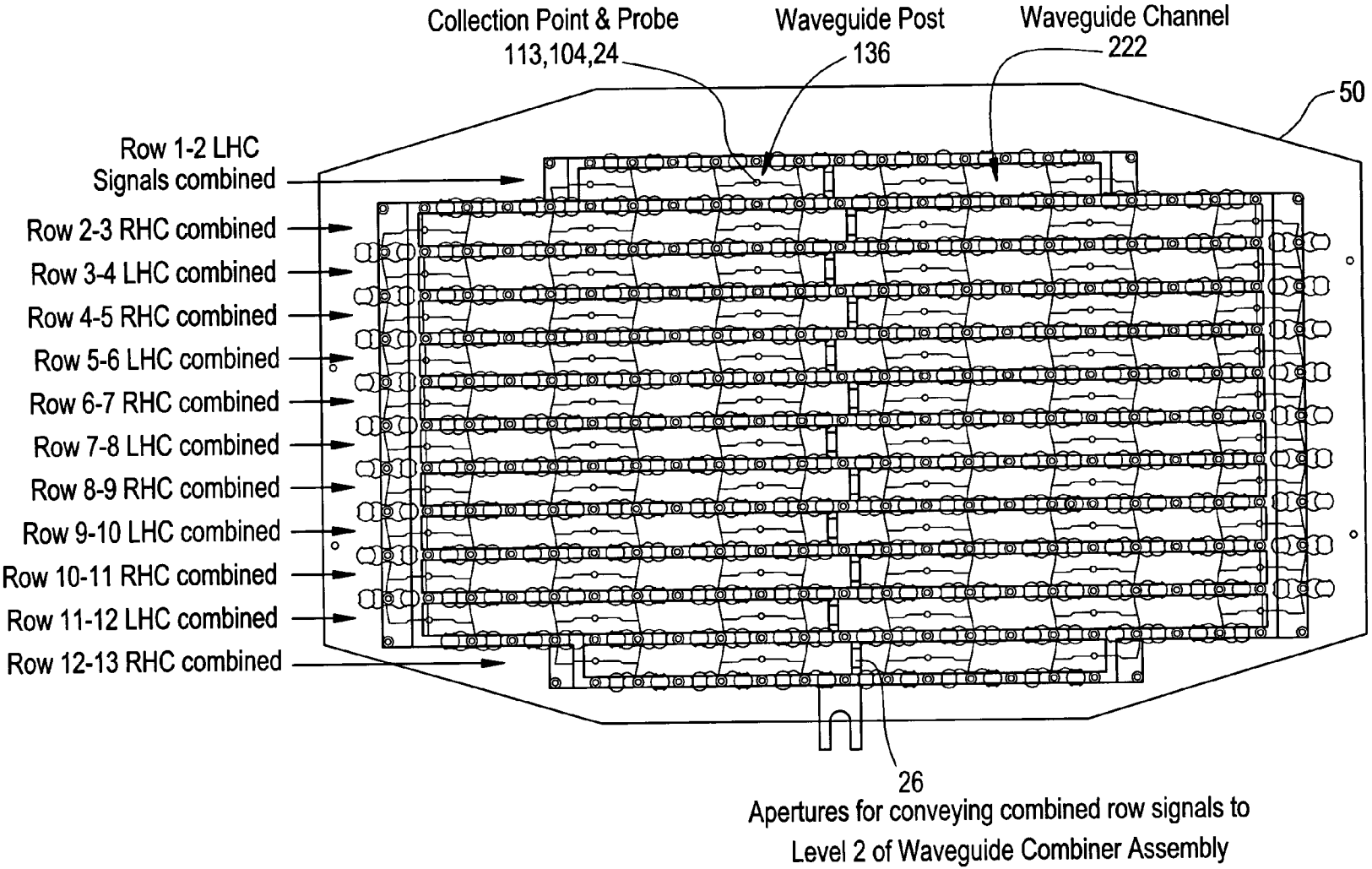
FIG. 4 represents a first waveguide that may be included in a waveguide combiner assembly.

FIG. 4 shows a first level waveguide 50 of the waveguide combiner assembly 40 (FIG. 1) superimposed on driven patch elements 12 to illustrate that one embodiment of a waveguide 50 may include a number of transmission lines and/or waveguide channels 222 that correspond with a plurality of feed points 104 and/or collection points 113. For example, a waveguide channel 222 may correspond to a row of collection points 104. It can be understood that other embodiments having differing numbers of waveguides 222 that may to correspond with differing numbers of rows of collection points 104 may be contemplated. FIG. 4 also shows a first junction 126 which may be an aperture for conveying combined signals to another level of the waveguide combiner assembly. As previously provided herein, in the illustrated embodiment, where collection points are configured for alternating rows of (collection points collecting) RHC and LHC combined signals, junction 126 and other junctions aligned (e.g., FIG. 4 column) with junction 126 may be reserved for one of LHC or RHC signal types, while other junctions not so aligned but illustrated in FIG. 4, may be reserved for the alternate signal type.

The one or more waveguide channels and/or transmission lines 222 may be reduced height rectangular waveguides. Reduced height waveguides may have a height b that can be less than, or equal to, half the width of the waveguide. Alternatively, waveguide channel 222 may be another known waveguide channel or waveguide. Waveguide channels 222 may differ and/or be the same waveguide or transmission line.

As provided previously herein, FIG. 4 illustrates part of waveguide assembly where each of sixty-eight common collection points 104 are coupled to individual probes 24 that extend through openings in a ground plane into a first level of a two level waveguide combiner assembly. Probes 24 may be, in an exemplary embodiment, laterally centered in waveguide 222 for ease of fabrication. The signal transition from microstrip array to waveguide assembly may result in an amplitude taper of the signal. As the example embodiment of FIG. 4 illustrates, each waveguide channel 222 corresponds to two rows of the microstrip array, but one row of collection/feed points which, in receive mode, combines either the LHC signals or the RHC signals of the two rows.

Figure 5:
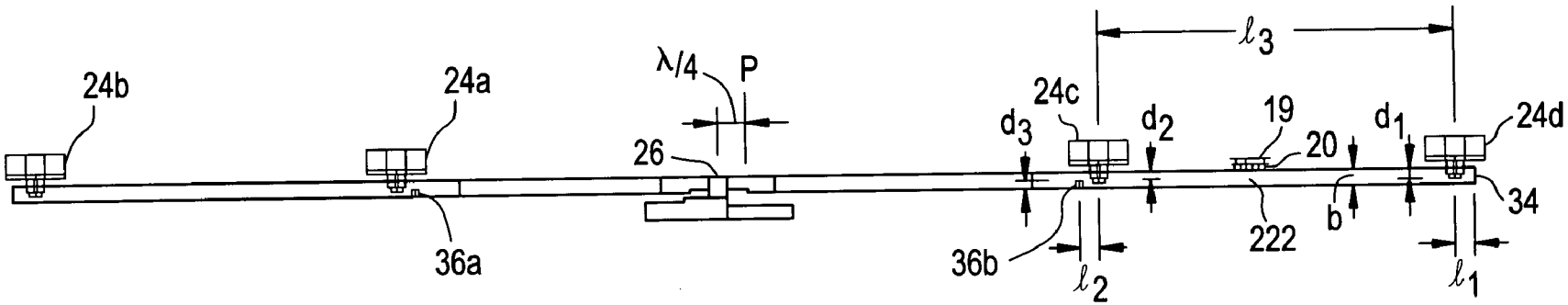
FIG. 5 is a partial cross sectional view showing a three port junction in a microstrip to waveguide transition; and, FIG. 6 represents a second waveguide that may be included in a waveguide combiner assembly.

Referring to FIG. 5, which shows a cross-sectional view of a microstrip network and transmission line or waveguide combiner assembly transition, microstrip array 23 can be disposed on a dielectric sheet 19 that can be disposed on a surface of a ground plane 20. The bottom surface of ground plane 20 may form a wall of a waveguide assembly 40 that comprises one or more waveguides 222 beneath ground plane 20.

As shown in FIG. 5, at least one probe 24*a–b* can extend from the microstrip network into a waveguide 222. In some embodiments, at least one probe 24*a–b* extends into at least one of waveguides 222. A probe 24 may include a pin and optionally a spacer and/or insulator that can be configured circumferentially around a pin. Such a spacer and/or insulator may include a fluoropolymer such as Teflon®, or another material.

As provided previously herein, a probe 24*a–d* and physical perturbation 36*a–b* may allow formation of a conjugate field that may bias a field in a particular direction, and/or provide an impedance to match a characteristic impedance of the transmission line/waveguide. As also provided previously herein, probe 24*a–d* and perturbation 36*a–b* may form a multiport coupler between the microstrip network and the waveguide. As indicated previously herein, probe 24*a–d* may comprise a first input port, while the combination of probe and physical perturbation 36*a–b* may bias a signal to create a second input port and an output port in a portion of the waveguide 222. For example, referring to FIG. 5, a second port may be created to the left of a probe 24*a–d*, away from the corresponding physical perturbation 36*a–b*, and a third port may be created to the right of a probe 24*a–d*, towards the corresponding physical perturbation 36*a–b*. The perturbation 36*a–b* may be disposed such that the impedance of the microstrip array and the waveguide assembly is substantially matched. Further, the probe 24*a–d* and physical perturbation 36*a–b* may be disposed relative to each other such that there is substantially limited insertion loss. In one embodiment, the waveguide combiner assembly can include a number of perturbations 36*a–b* that correspond to the number of probes 24*a–d*.

Accordingly, physical perturbation 36*b* can be spaced a distance 12 from probe 24*c* in a direction towards a first junction 26 in the first waveguide assembly. Physical perturbation 36*b* may extend into waveguide 222 a distance d3 from a side of waveguide 222 opposite that of probe 24*c*.

For the exemplary embodiment illustrated in FIG. 5, individual signals for particular rows of the waveguide assembly 50 can then transmitted to a second level of waveguide combiner assembly 60 via at least one first junction 26.

The first junction 26 can be located between the two central probes, designated in FIG. 5 as probes 24*a,c*, with the two probes furthest from e-plane junction 26 being designated as probes 24*b,d*. The first junction 26 may allow for a substantially smooth change in the direction of the axis of the waveguides, throughout which the axis remains substantially in a plane parallel to the direction of electric E-field (transverse) polarization. For example, first junction 26 may introduce a 180° phase shift between signals reaching a junction from opposite sides of first junction 26, i.e., from the left and right sides in relation to the orientation of FIG. 5. A first junction 26 can receive signals from both left and right sides (in relation to the orientation of FIG. 5) of waveguide 222. First junction 26 may direct signals from waveguide 222 into a feed waveguide located below waveguide 222. Further, probes 24*a–d* may be present on both sides of a first junction, or on one side of a first junction.

Signals from opposite directions arriving at first junction 26 in phase may cancel upon entering the first junction 26. To reduce the likelihood of signal cancellation, for example, first junction 26 can be offset from the mid-point p between the probes by a distance corresponding to about a quarter of a wavelength, $\lambda/4$. Signals from one set of probes 24*a*, 24*b*, for example, to the illustrated left of the first junction 126 in FIG. 5, can arrive at first junction 126 180° out of phase from signals from the other set of probes 24*c*, 24*c*, for example, to the illustrated right of first junction 126 in FIG. 5, so as to combine the signals from the two sets of probes 24*a–d* at e-phase junction 26.

The antennas of the present disclosure may be configured in a receive mode of operation, for example, when antenna 10 may be receiving signals from a source. Alternatively, the antennas of the present disclosure may be transmitting signals. In some embodiments, an antenna may be operated in a transmit mode where power from a first junction 26 to one set of probes 24*a–b*, 24*c–d* may be 180° out of phase from power to the other set of probes 24*a–b*, 24*c–d*. In the known manner described, an about $\lambda/4$ offset from a mid-point between a probe and the first junction may compensate for the phase difference introduced by the first junction 26, such that power to the set of probes 24*a–b*, 24*c–d* to either side of first junction 26 may be in phase.

Figure 6:
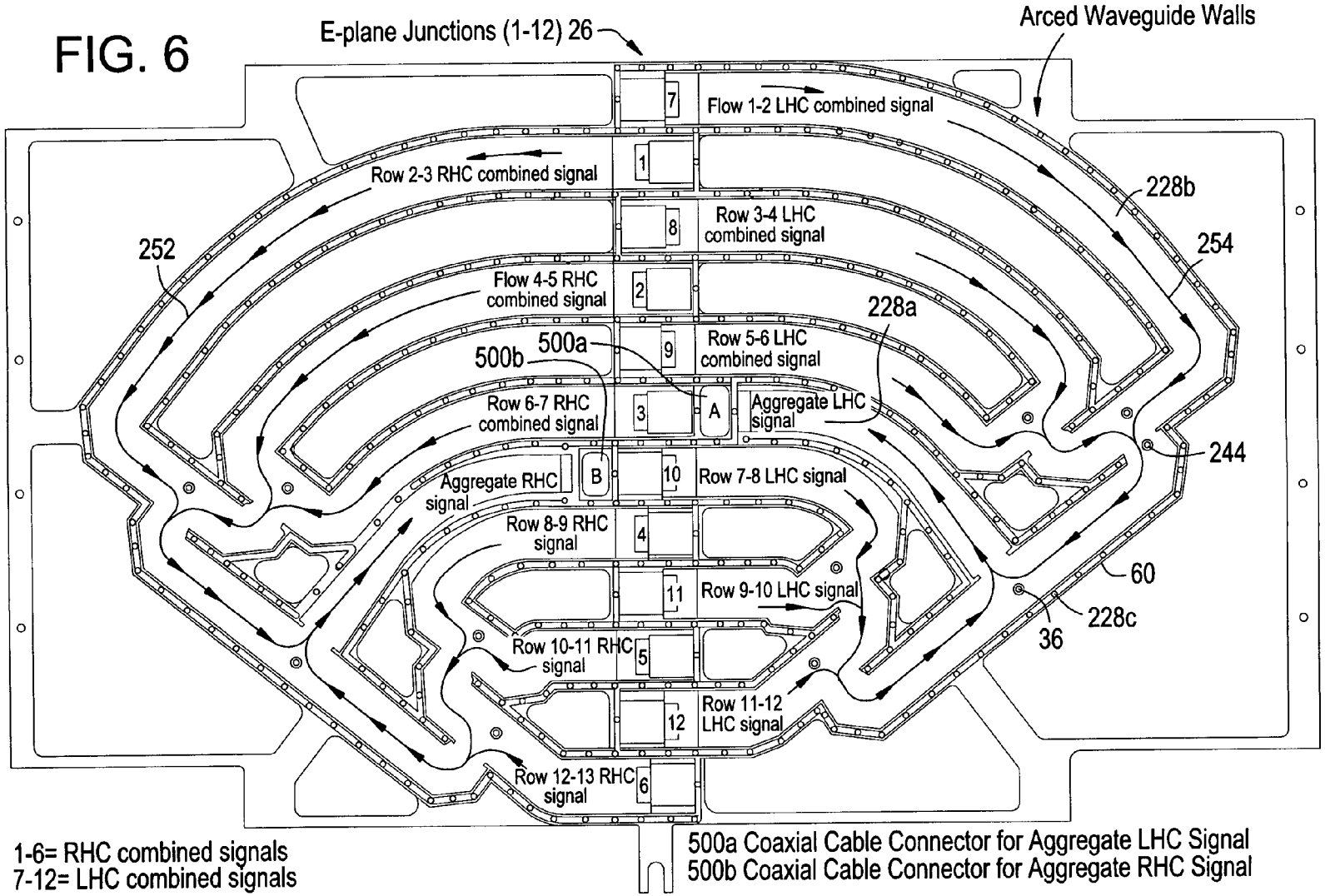

FIG. 6 illustrates a fan shaped second waveguide assembly 60. For the illustrated embodiments, signals from waveguide 50 can enter second waveguide assembly 60 through at least one first junction 26 (e.g., twelve junctions as illustrated in the example embodiment of FIG. 6, corresponding to rows of first waveguide assembly 50 as designated in FIG. 6). Waveguide assembly 60 may have a number of branches 228*b* to correspond to the number of waveguides 222. In some embodiments, at least one second junction 244 may be located at the ends of branches 228*b*. Second junction 244 may be formed by a physical perturbation as previously provided herein. Second junction 244 may act to combine and/or aggregate signals from two or more branches 228*b* (e.g., Row 1-2 LHC combined signal with Row 3-4 LHC combined signal with Row 5-6 LHC combined signal) into combined branches 228*c*.

Second junction 244 may allow for a substantially smooth change in the direction of the axis of a waveguide, for example, waveguide 228*b*, throughout which the axis remains in a plane substantially parallel to the direction of magnetic H-field (transverse) polarization. Second junction 244 may include a reduced width section. Additional junctions may include at least one physical perturbation 36, which may be grounded. Such a physical perturbation 36 may, at least in part, determine a power split. In an embodiment, a second junction may be a three port junction which may combine signals at a predetermined power ratio.

In some embodiments, a waveguide 60 may comprise a multiple, or a plurality of second junctions or three port junctions 244. Additional second junctions may be provided to successively combine signals until signals from the branches 228*b* may be combined into one signal propagating in a major branch 228*d*.

For example, combined and/or aggregated signals may propagate through combined branches 228*c* of feed waveguide 60. In one embodiment, signals may exit major branches 228*d* at slots 500*a–b*. In an embodiment, wedges 48 at the ends of major branches 228*d* may bend and/or direct the propagation path about 90° such that signals may exit major branches 228*d* at slots 500. In an exemplary embodiment, the second waveguide assembly 60 may include one or more slots 500*a–b*.

Antenna 100 may be so configured as to receive signals with different polarizations, and antenna 100 may separate the signals by polarization, such that each radiation waveguide channel 228 may receive signals of one polarization.

In some embodiments, the polarizations in the radiation waveguides 228 alternate, that is, adjacent radiation waveguides 228 may contain signals having substantially mutually orthogonal polarizations. For example, FIG. 6 depicts a first and second polarizations designated as arrows 252 and 254, respectively. Referring to exemplary FIG. 6, the waveguide assembly can be configured to direct first polarization signals to the left and second polarization signals to the right. Signals exiting slot 500*a* may comprise substantially first polarization signals 252 and signals exiting slot 500*b* thus may comprise substantially second polarization signals 254.

In some embodiments, waveguide assembly 60 provides for signals such that phases of signals propagating in waveguides 228 may be out of phase. For second junctions 244 to combine the signals, second junctions 244 may require the signals arriving at the junctions to be in phase. Lengths of waveguides 228 may be adjusted such that signals, for example, in branches 228*b* may be substantially in phase at the appropriate second junction 244.

Physical perturbations 36 may extend into a second waveguide assembly 60 to provide further attachment of first waveguide assembly 50 to waveguide assembly 60. In some embodiments, this attachment may reduce signal leakage.

The second waveguide assembly may be positioned to be in operable communication with the first waveguide assembly such that a distance from a signal path in the second waveguide assembly in relation to the top of the first waveguide assembly establishes an evanescent-mode of signal propagation.

While specific embodiments of the subject invention have been discussed, the above specification is illustrative and not restrictive. Many variations of the invention will become apparent to those skilled in the art upon review of this specification. The full scope of the invention should be determined by reference to the claims, along with their full scope of equivalents, and the specification, along with such variations.

Unless otherwise indicated, all numbers expressing quantities of parameters, descriptive features and so forth used in the specification and claims are to be understood as being modified in all instances by the term "about." Accordingly, unless indicated to the contrary, the numerical parameters set forth in this specification and attached claims are approximations that may vary depending upon the desired properties sought to be obtained by the present disclosure.

Elements, component, modules, and/or parts thereof that are described and/or otherwise portrayed through the figures to communicate with, be associated with, and/or be based on something else, can be understood to so communicate, be associated with, and/or be based on in a direct and/or indirect manner, unless otherwise stipulated herein.

All publications and patents mentioned herein, including those items listed below, are hereby incorporated by reference in their entirety as if each individual publication or patent was specifically and individually indicated to be incorporated by reference. In case of conflict, the present application, including any definitions herein, will control.

Also incorporated by reference are the following patents and patent applications: U.S. Ser. Nos. 10/290,667, 10/290,666, U.S. Pat. No. 6,297,774, and U.S. Pat. No. 6,512,431.

What is claimed is:

1. A device comprising:

a microstrip network, disposed on a ground plane, comprising at least one collection point, where said at least one collection point is in electrical communication with said microstrip network;

a probe associated with each of said at least one collection points, said probe extending through at least one opening in said ground plane and in electrical communication with at least one first transmission line; and, a first physical perturbation associated with said probe, said first physical perturbation integrated with said at least one first transmission line to create a first signal port in the at least one first transmission line and a second signal port in said at least one first transmission line.

2. The device of claim 1, where the first physical perturbation includes at least one of: a post, a cylinder, a ridge, a cleft, an iris, and a transmission line width.

3. The device of claim 1, where the first physical perturbation is based on at least one of: a characteristic impedance of the at least one first transmission line, and a desired directivity of signals propagating along the at least one first transmission line.

4. The device of claim 1, where at least one physical characteristic of the first physical perturbation is selected based on at least one of: a characteristic impedance of the first at least one transmission line, and a desired directivity of signals propagating along the at least one first transmission line.

5. The device of claim 4, where the at least one physical characteristic includes at least one of: a shape, a size, a width, a physical dimension, a position, a distance from the associated probe, a physical association with the at least one first transmission line, and a physical association to the at least one first transmission line.

6. The device of claim 1, where the at least one collection point is capable of at least one of: receiving energy from the microstrip network, and delivering energy to the microstrip network.

7. The device of claim 1, where the probe is capable of at least one of: delivering energy to the at least one first transmission line, and receiving energy from the at least one first transmission line.

8. The device of claim 1, where the probe, the first port, and the second port are associated with a three port signal coupler provided by the first physical perturbation.

9. The device of claim 1, where each of the at least one collection points communicate one of: right-hand circularly polarized energy or left-hand circularly polarized energy.

10. The device of claim 9, where the at least one first transmission line includes at least one of: at least one transmission line for right-hand circularly polarized energy and at least one transmission line for left-hand circularly polarized energy.

11. The device of claim 1, where said at least one first transmission line includes a rectangular waveguide channel.

12. The device of claim 1, where said microstrip network comprises microstrip patch elements.

13. The device of claim 12, where said microstrip patch elements comprise driven patch elements.

14. The device of claim 13, where said microstrip network comprises six or eight driven patch elements associated with said at least one common collection point.

15. The device of claim 14, where said driven patch elements are connected with said at least one common collection point by at least one second transmission line, said at least one second transmission line integrated with a second physical perturbation.

16. The device of claim 15, where said second physical perturbation is a linewidth change in said at least one second transmission line.

17. The device of claim 13, where said microstrip network is an array of said driven patch elements.

18. The device of claim 12, where said microstrip patch elements are at least one of coupled with and connected to at least one second transmission line.

19. The device of claim 1, where said probe further comprises at least one of a spacer element and an insulating element.

20. The device of claim 19, where said spacer element comprises a fluoropolymer.

21. An antenna comprising:

a microstrip network disposed on a ground plane, comprising at least one collection point, where said at least one collection point is in electrical communication with said microstrip network;

a first waveguide assembly; and a probe associated with each of said at least one collection points, said probe extending through at least one opening in said ground plane to said first waveguide assembly, where said first waveguide assembly comprises at least one physical perturbation, the at least one physical perturbation associated with said probe and integrated with said first waveguide assembly to create a first signal port in said first waveguide assembly and a second signal port in said first waveguide assembly.

22. The antenna of claim 21, where said first waveguide assembly comprises a first waveguide channel for communicating substantially left hand circularly polarized signals.

23. The antenna of claim 22, where said first waveguide assembly further comprises a second waveguide channel for communicating substantially right hand circularly polarized signals.

24. The antenna of claim 23, where said first and second waveguide channels are independently electrically isolated.

25. The antenna of claim 24, where said first and second waveguide channels are separated by a waveguide wall comprising a recess.

26. The device of claim 25, where said recess is substantially filled with a composition comprising a conductive epoxy resin.

27. The antenna of claim 21, where said microstrip network comprises a two dimensional array of microstrip patch elements and collection points.

28. The antenna of claim 27, where at least one of a row and a column of said collection points is physically aligned with said first waveguide channel.

29. The antenna of claim 21, where said physical perturbation includes at least one of: a post, a cylinder, a ridge, a cleft, an iris, and a waveguide width.

30. The antenna of claim 21, where location of said physical perturbation is based on a width of said first waveguide channel.

31. The antenna of claim 21, further comprising a second waveguide assembly in electrical communication with the first waveguide assembly.

32. The antenna of claim 31, further comprising a first signal junction to communicate signals between said first waveguide assembly and said second waveguide assembly.

33. The antenna of claim 32, where said second waveguide assembly is substantially fan-shaped.

34. The antenna of claim 33, where said second waveguide assembly includes varying length waveguide channels.

35. The antenna of claim 34, where the varying length waveguide channels introduce at least one time delay to compensate for antenna tilt.

36. The antenna of claim 33, where said second waveguide assembly comprises a second signal junction.

37. The antenna of claim 36, where said second junction communicates signals between the second waveguide assembly and a third transmission line.

38. The antenna of claim 31, where said second waveguide assembly includes at least one physical perturbation.

39. The antenna of claim 21, where said probe produces an amplitude taper in a signal.

* * * * *